US005653290A

United States Patent [19]

Bland

[11] Patent Number: 5,653,290

[45] Date of Patent: Aug. 5, 1997

[54] ROTATING ROD STRING POSITION ADJUSTING DEVICE

[75] Inventor: Linden H. Bland, Edmonton, Canada

[73] Assignee: Campbell Industries Ltd., Edmonton, Canada

[21] Appl. No.: 440,001

[22] Filed: May 12, 1995

[51] Int. Cl.[6] ..... E21B 19/02

[52] U.S. Cl. ..... 166/381; 166/77.51; 254/29 R

[58] Field of Search ..... 166/355, 67, 77.52, 166/379, 68, 68.5, 109, 381; 254/29 R, 30

[56] References Cited

U.S. PATENT DOCUMENTS

| | | | |
|---|---|---|---|
| Re. 25,680 | 11/1964 | Brown . | |
| 1,447,744 | 3/1923 | Wright | 166/77.52 |
| 1,454,088 | 5/1923 | Thrift | 166/77.52 |
| 1,999,174 | 4/1935 | Jackson . | |
| 3,099,323 | 7/1963 | Kelly | 166/77.52 X |
| 3,166,125 | 1/1965 | Hubby . | |
| 3,177,943 | 4/1965 | McCoy . | |
| 4,209,066 | 6/1980 | Watson . | |
| 4,320,799 | 3/1982 | Gilbertson | 166/68.5 |
| 4,437,515 | 3/1984 | Boyadjieff et al. | 166/77.52 X |
| 4,465,131 | 8/1984 | Boyadjieff . | |
| 4,479,537 | 10/1984 | Reed . | |
| 4,632,183 | 12/1986 | McLeod . | |
| 4,676,312 | 6/1987 | Mosing . | |
| 4,791,997 | 12/1988 | Krasnov | 166/77.52 X |
| 4,890,671 | 1/1990 | Boxter | 166/77.52 X |
| 5,327,961 | 7/1994 | Mills | 166/68.5 |

*Primary Examiner*—Frank Tsay
*Attorney, Agent, or Firm*—Rodman & Rodman

[57] ABSTRACT

The invention relates to a method and a device for longitudinally adjusting the position of a rotating rod string, having an upper end and a lower end, in a production well of the type having a downhole rotary pump connected to the lower end of the rod string, means for driving the rotary pump by rotating the rod string, and a lower clamp operably connected to the driving means and releasably fixable near the upper end of the rod string such that operation of the driving means rotates the lower clamp which rotates the rod string. The device is comprised of a tubular inner sleeve having a threaded outer surface and a lower end for removably mounting on the lower clamp such that the rod string is contained therein and rotation of the lower clamp by the driving means rotates the inner sleeve. A tubular outer sleeve having an upper end and a threaded inner surface is mounted about and threadably engaged with the inner sleeve. An upper clamp is mounted on the upper end of the outer sleeve and is releasably fixable to the rod string so that while the lower clamp is released from the rod string and the upper clamp is fixed to the rod string, operation of the driving means rotates the lower clamp and the inner sleeve such that the outer sleeve telescopes relative to the inner sleeve until the rod string is longitudinally adjusted within the well by longitudinal movement of the upper clamp.

30 Claims, 11 Drawing Sheets

ROTATING ROD STRING POSITION ADJUSTING DEVICE

TECHNICAL FIELD

The invention relates to a device for longitudinally adjusting the position of a rotating rod string in a production well.

BACKGROUND ART

A downhole rotary pump, commonly referred to as a progressive cavity pump, is used in a production well for producing a formation. The rotary pump is typically driven by an electric or hydraulic motor, located at the surface of the ground, which is connected by a clamp to a rod string. The rod string extends downwardly into the tubing of the production well from the surface to the rotary pump. The rod string may include a plurality of rods interconnected by rod couplings and is connected to the rotary pump. The rod string may also include a further coupling referred to as a shear coupling located just above the rotary pump. The rod couplings and the shear coupling are larger in diameter than the rods.

Typically, the rotation of the rod string by the motor causes wearing of the tubing in the production well. Wearing occurs along the length of the rod string but is greatest at the locations where the rod couplings and the shear coupling contact the inner surface of the tubing. Wearing by the couplings on the tubing can result in a hole developing in the tubing and possible loss of the produced fluids back down the production well.

Further, rotary pumps are used most commonly in areas where the producing formation is an unconsolidated oilsand. As a result, high concentrations of silt and sand may be produced along with any produced fluids from the formation. The abrasive nature of the silt and sand accelerates the wearing that occurs between the rod string and the inner surface of the tubing, particularly when the production well is slant, directionally or horizontally drilled.

It has been found that if the rod string and the couplings are periodically adjusted relative to the surface by raising or lowering the rod string by approximately the length of the coupling, the localized wearing of the tubing by the couplings can be distributed along the inner surface of the tubing. Thus, the life of the tubing, before the development of a hole, may be significantly extended. Conventionally, the raising or lowering of the rod string is accomplished by the use of a truck mounted crane such as a work-over rig, a flush by rig or a cherry picker. The crane manually lifts or lowers the rod string to a point where it is reclamped and thereby adjusts its position in the production well. These cranes are typically inconvenient, cumbersome and expensive to use.

In addition, although not used for the particular purpose or function indicated above, several devices exist in the industry which may be used to adjust the position of a pipe or a rod string in a well. Each of the devices includes a complex structure for performing its particular function.

U.S. Pat. No. 1,999,174 issued Apr. 30, 1935 to Jackson relates to a combination hoisting and lifting jack which is used for hoisting imbedded rods and pipes such as rod strings. This device includes a complex structure which resembles a conventional screw type jack. The device includes a base portion, which supports the jack adjacent the pipe to be lifted, and a set of claws for engaging a clamp which is fixed to the pipe. Hoisting occurs by rotating an actuating nut, which raises or lowers a feed screw to move the clamp. The rotation of the actuating nut is controlled by a ratchet assembly.

U.S. Pat. No. 3,166,125 issued Jan. 19, 1965 to Hubby relates to an adjustable casing head whereby a load bearing collar is fixed to the top end of a surface pipe and a separate collar is fixed to the top end of the casing string. These two collars are moved either together or apart with the use of a number of hydraulic units or screw-type jacks located adjacent the pipe to be lifted.

U.S. Pat. No. 4,632,183 issued Dec. 30, 1986 to McLeod relates to an insertion drive system for a wellhead tree saver. The device includes a complex structure for forcing high pressure tubing downwards into a tree saver using motor driven mechanical jack assemblies. The device is comprised of a lower beam, which is attached to the christmas tree, and an upper beam, which is spaced from and parallel with the lower beam. A pair of screw-type jack assemblies powered by independent motor means are located between the upper and lower beams adjacent the tubing for moving the beams together and apart.

U.S. Pat. No. 3,177,943 issued Apr. 13, 1965 to McCoy relates to an oilwell pump which can be manipulated to open and close valves and thus produce fluid from up to three different stratum. This manipulation is accomplished by raising or lowering the tubing string using a jack. The jack includes a lower worm wheel which is supported by thrust bearings. Rotation of the worm wheel raises or lowers the tubing string. The worm wheel is rotated externally by rotation of a worm.

U.S. Pat. No. 5,143,153 issued Sep. 1, 1992 to Bach et. al. relates to a sucker rod lifting apparatus for use with a downhole rotary oilwell pump which is designed for the purpose of freeing a stuck rotor or reducing excessively high torque that results from high concentrations of clay, silt or unconsolidated oilsands between the pump rotor and the pump stator. The device is a complex apparatus forming an integral part of the wellhead and comprising an upper and a lower carrier plate. Two hydraulic cylinders are positioned between the carrier plates adjacent the sucker rod. Raising or lowering of the upper carrier by actuation of the hydraulic cylinders, powered by the motor that drives the rotary oilwell pump, raises or lowers the rotary oilwell pump and the sucker rod. The motor normally used to drive the pump must be specially adapted in order to be used for actuation of the hydraulic cylinders.

Given the complexity of the structure and operation of the prior art devices used to perform the different functions discussed therein, there remains a need in the industry for a device designed to longitudinally adjust the position of the rod string in the production well which is portable and relatively simple with respect to both its structure and mode of operation. With respect to the mode of operation, there is a need for a device that utilizes the normal action of the rotary pump motor, which normally rotates the rod string, for performing the jacking or adjusting function, thus eliminating any need for other mechanical or hydraulic power sources to operate the device and the jacking mechanism.

DISCLOSURE OF INVENTION

The present invention relates to a device for longitudinally adjusting the position of a rotating rod string in a production well, of the type having a downhole rotary pump and means for driving the rotary pump located at the surface, which device has a relatively uncomplicated structure as compared to prior art devices. As well, the invention relates to the device having a relatively simple mode of operation in which the normal action or operation of the rotary pump driving means actuates the device and results in the longitudinal adjustment of the rod string position. As well, the invention relates to a device that is portable such that it can easily be carried by hand from production well to production well. Finally, the invention also relates to a method for using the device to longitudinally adjust the position of the rod string in the production well.

In an embodiment of the invention in its apparatus form, the invention is comprised of a device for longitudinally adjusting the position of a rotating rod string, having an upper end and a lower end, in a production well of the type having a downhole rotary pump connected to the lower end of the rod string, means for driving the rotary pump by rotating the rod string, and a lower clamp operably connected to the driving means and releasably fixable near the upper end of the rod string in order to connect the driving means to the rod string and in order to support the rod string in the well such that operation of the driving means rotates the lower clamp which rotates the rod string, the device comprising:

(a) a tubular first sleeve having a threaded surface, an upper end and a lower end for removably mounting on the lower clamp such that a portion of the rod string is contained within the first sleeve and rotation of the lower clamp by the driving means rotates the first sleeve;

(b) a tubular second sleeve having an upper end, a lower end and a threaded surface compatible with the threaded surface of the first sleeve, the second sleeve mounted and threadably engaged with the first sleeve to permit telescoping of the second sleeve relative to the first sleeve; and (c) an upper clamp mounted on the upper end of the second sleeve and releasably fixable to the rod string for supporting the rod string in the well so that while the lower clamp is released from the rod string and the upper clamp is fixed to the rod string, operation of the driving means rotates the lower clamp and the first sleeve such that the second sleeve telescopes relative to the first sleeve until the rod string is longitudinally adjusted within the well by longitudinal movement of the upper clamp resulting from the telescoping of the second sleeve relative to the first sleeve.

Preferably, the first sleeve of the device is an inner sleeve which has a threaded outer surface and the second sleeve is an outer sleeve which has a threaded inner surface. As a result, the outer sleeve is mounted about the inner sleeve in a manner such that the outer surface of the inner sleeve is threadably engaged with the inner surface of the outer sleeve. Further, when so mounted, the driving means for the rotary pump preferably rotates the lower clamp and the inner sleeve mounted on it in a manner so that the outer sleeve telescopes relative to the inner sleeve from a closed position towards an extended position.

As well, the rod string may be comprised of a polished rod having a length. Preferably, the outer sleeve is capable of telescoping relative to the inner sleeve for a distance of less than about one-half of the length of the polished rod, or preferably between about 4 and 5 inches.

In addition, the device may include means for retarding the rotation of the outer sleeve while the inner sleeve is rotated. The retarding means acts to inhibit the rotation of the outer sleeve in order to permit the telescoping of the outer sleeve relative to the inner sleeve. However, preferably the telescoping of the outer sleeve relative to the inner sleeve is permitted as a result of minimizing the friction between the inner surface of the outer sleeve and the outer surface of the inner sleeve. To minimize the friction in the preferred embodiment of the device, the threaded outer surface on the inner sleeve is a ball screw and the threaded inner surface on the outer sleeve is a ball nut.

Further, the device may further include means for fixing the outer sleeve to the inner sleeve in order to prevent further telescoping of the outer sleeve relative to the inner sleeve when the outer sleeve is in the extended position. The fixing means may be a pawl assembly between the inner and outer sleeves, however, preferably the fixing means are comprised of a plunger and a slot for receiving the plunger. The plunger preferably has a first end extending through the outer sleeve, preferably at a point between the ball nut and the upper end of the outer sleeve, for releasable engagement with the inner sleeve. The slot is preferably defined by the outer surface of the inner sleeve, preferably at its upper end. The fixing means also preferably includes means for urging the plunger towards the inner sleeve, which is preferably a spring.

In an embodiment of the invention in its method form, the invention is comprised of a method for longitudinally adjusting the position of a rotating rod string, the rod string having an upper end and a lower end, in a production well of the type having a downhole rotary pump connected to the lower end of the rod string, means for driving the rotary pump by rotating the rod string, and a lower clamp operably connected to the driving means and releasably fixable near the upper end of the rod string in order to connect the driving means to the rod string, and in order to support the rod string in the well such that operation of the driving means rotates the lower clamp which rotates the rod string. The method uses a device comprised of a tubular first sleeve having a threaded surface, an upper end and a lower end for removably mounting on the lower clamp, a tubular second sleeve having an upper end, a lower end and a threaded surface compatible with the threaded surface of the first sleeve, the second sleeve mounted and threadably engaged with the first sleeve to permit telescoping of the second sleeve relative to the first sleeve, and an upper clamp mounted on the upper end of the second sleeve and releasably fixable to the rod string. The method is comprised of the steps of:

(a) mounting the device on the well by mounting the lower end of the first sleeve on the lower clamp such that a portion of the rod string is contained within the first sleeve and rotation of the lower clamp by the driving means rotates the first sleeve;

(b) fixing the upper clamp to the rod string;

(c) releasing the lower clamp from the rod string such that the upper clamp supports the rod string in the well; and (d) operating the driving means in order to rotate the lower clamp and the first sleeve such that the second sleeve telescopes on the first sleeve until the rod string is longitudinally adjusted within the well by longitudinal movement of the upper clamp resulting from the telescoping of the second sleeve relative to the first sleeve.

As indicated previously, the first sleeve of the device is preferably an inner sleeve which has a threaded outer surface and the second sleeve is preferably an outer sleeve which has a threaded inner surface. In the preferred embodiment, the outer sleeve is mounted about the inner sleeve so that the outer surface of the inner sleeve is threadably engaged with the inner surface of the outer sleeve.

Further, in performing the operating step, step (d), the driving means preferably rotates the lower clamp and the inner sleeve such that the outer sleeve telescopes relative to the inner sleeve from the closed position towards the extended position. As well, the method may further include the steps, following step (d) of:

(e) fixing the lower clamp to the rod string once the rod string has been longitudinally adjusted;

(f) releasing the upper clamp from the rod string such that the lower clamp supports the rod string in the well; and (g) removing the device from the well.

Following step (d), the outer sleeve may be fixed to the inner sleeve in order to prevent further telescoping of the outer sleeve relative to the inner sleeve. In addition, during step (d), rotation of the outer sleeve may be retarded in order to permit telescoping of the outer sleeve relative to the inner sleeve. However, preferably, during step (d), the friction between the inner surface of the outer sleeve and the outer surface of the inner sleeve is minimized in order to permit the telescoping.

Following step (f), the outer sleeve may be telescoped relative to the inner sleeve back towards the closed position and steps (b) through (f) may be repeated in order to progressively adjust the rod string in the well.

BRIEF DESCRIPTION OF DRAWINGS

The embodiments of the invention will now be described with reference to the accompanying drawings in which.

BEST MODE OF CARRYING OUT INVENTION

Figure 1:
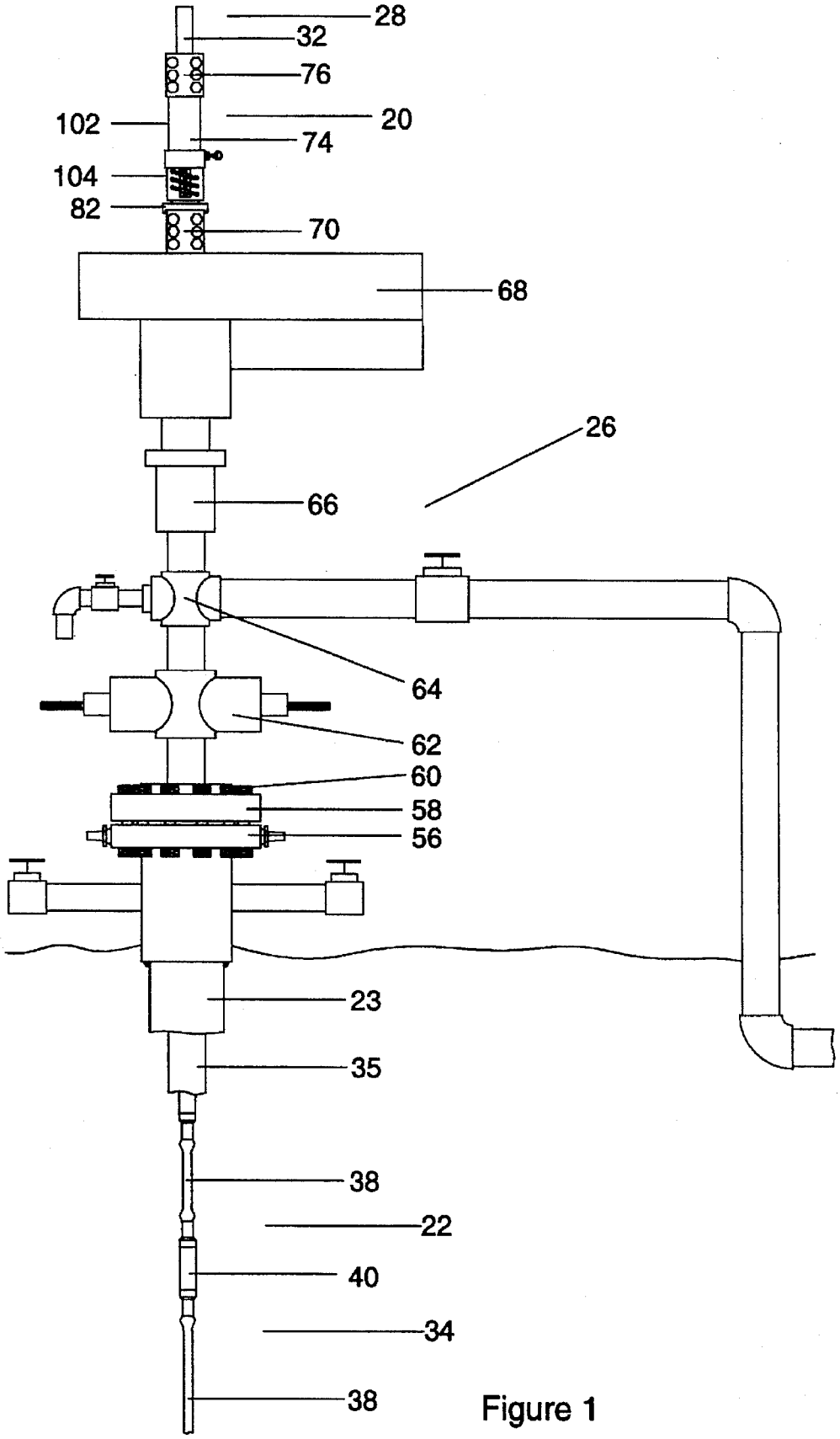
FIG. 1 is a pictorial side view of a wellhead of a production well of the type having a rotating rod string, in which the device is mounted to the wellhead for operation.
Figure 2:
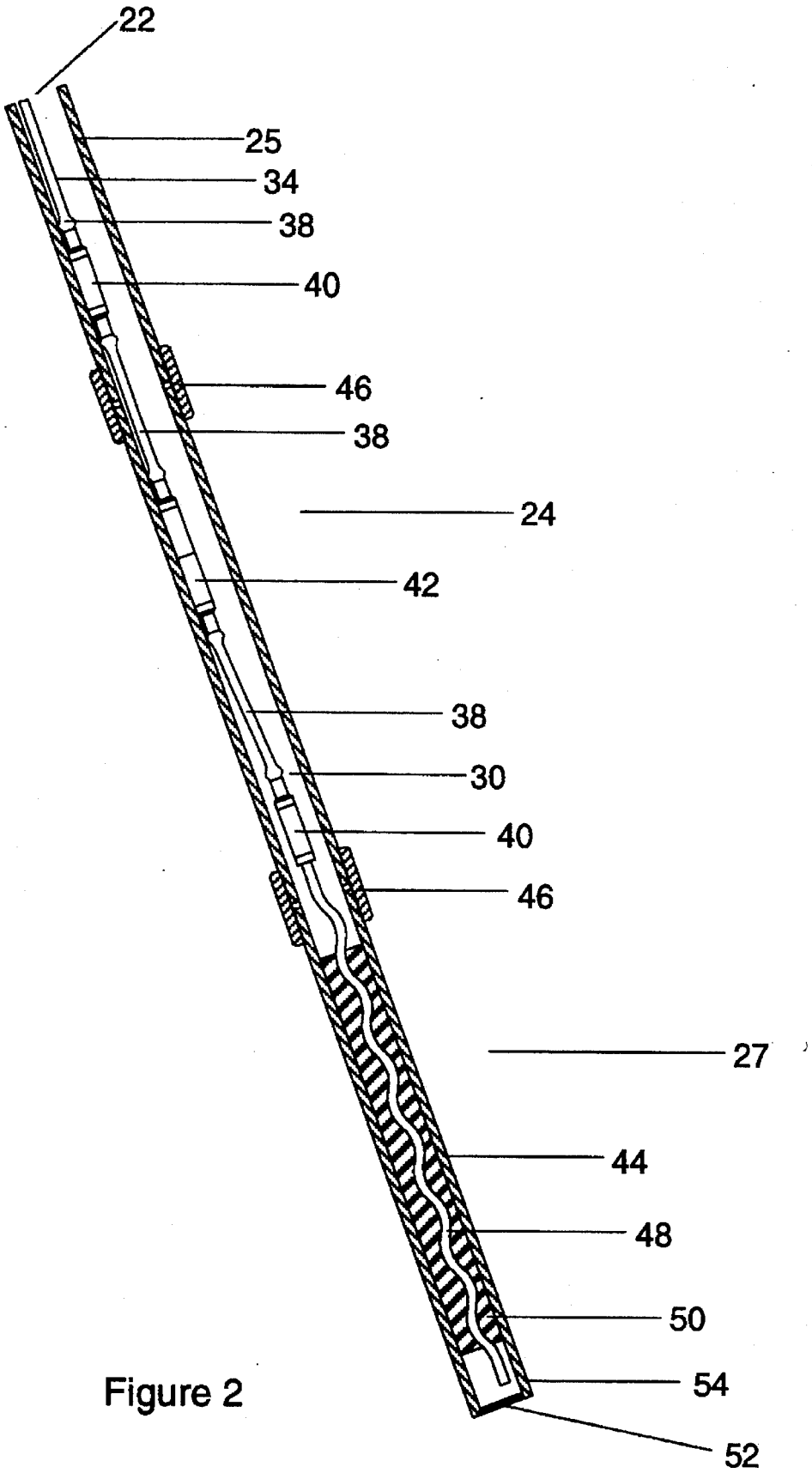
FIG. 2 is a longitudinal sectional view of a lower end of the production well of FIG. 1 showing a side view of a downhole rotary pump connected to a lower end of the rotating rod string.

Referring to FIGS. 1 and 2, the within invention is a device (20) for longitudinally adjusting the position of a rotating rod string (22) in a wellbore (24) of a production well. The production well includes the rotating rod string (22) and a conventional wellhead (26). The rotating rod string (22) is run through the wellhead (26) into the wellbore (24). The wellbore (24) is typically completed by cementing a casing string (23) in at least the upper portion of the wellbore (24). A tubing string (25) is then run inside the casing string (23) and through the wellbore (24) from the wellhead (26) to a downhole rotary pump (27) shown in FIG. 2.

The rod string (22) is run through the tubing string (25) and is comprised of a number of parts from an upper end (28) to a lower end (30). The upper end (28) at the surface of the ground includes a polished rod (32) that extends through the entire wellhead (26) and has a length defined by its longitudinal axis. The polished rod (32) provides a smooth sealable surface between the rotating rod string (22) and the parts comprising the wellhead (26) as set out below. The polished rod, (32) is connected to a sucker rod string (34) which extends downwardly from the polished rod (32) into the wellbore (24) to the rotary pump (27), shown in FIG. 2. Thus, the length of the polished rod (32) is the distance between the upper end (28) of the rod string (22), also being the upper end of the polished rod (32) and the sucker rod string (34).

The sucker rod string (34) is comprised of a series of rods (38) which are typically about 25 feet in length and about $\frac{7}{8}$ of an inch to 1 inch in diameter. The rods (38) are connected to each other by rod couplings (40). The rod couplings (40) are typically about 4 inches in length and about $1\frac{13}{16}$ inches to $2\frac{3}{16}$ inches in diameter. Alternatively, the sucker rod string may be a continuous rod which is either round or oval in cross-section. The continuous rod is brought to the production well on a large reel and is run into the production well by a specially designed rig.

In either case, referring to FIG. 2, the sucker rod string (34) may be connected to the downhole rotary pump (27) by a shear coupling (42) and a relatively short length of a rod (38). The shear coupling (42) provides a weak point in the sucker rod string (34) that will part when the rods (38) are pulled to a stress just below the yield point of the sucker rod string (34). Further, if the rotary pump (27) becomes stuck, the rods (38) can be parted at the shear coupling (42) and pulled from the wellbore (24) without damaging them.

The rotary pump (27) is located at the lower end (30) of the rod string (22) and is comprised of a pump barrel (44) attached to the tubing string (25) by a tubing coupling (46), a rotor (48) attached to the lower end (30) of the rod string (22) by a rod coupling (40), and a stator (50) contained within the pump barrel (44). A tag bar (52) across a lower end (54) of the pump barrel (44) prevents the rotor (48) from being run out of the pump barrel (44) and serves as a reference to position the rotor (48) in the stator (50). The rotor (48) and the stator (50) range from about 10 to 35 feet in length, but are typically about 15 feet.

A conventional wellhead (26) is comprised of a wellhead flange (56) and an adaptor flange (58) held together by a plurality of screws or bolts (60). Further, the wellhead (26) is comprised of a rod blowout preventer (62) mounted on the adaptor flange (58), a flow tee (64) mounted on the blowout preventer (62), and a rod stuffing box (66) mounted on the flow tee (64). A rotary pump drive or motor (68), which drives the rotary pump (27) by rotating the rod string (22), is mounted upon the rod stuffing box (66). Typically, a clamp, referred to herein as a lower clamp (70) holds or is clamped near the upper end (28) of the rod string (22), being the polished rod (32), in order that the rod string (22) is suspended in the wellhead (26) and the wellbore (24). The lower clamp (70) is supported by and operably connected to the motor (68). As well, the lower clamp (70) is releasably fixable to the polished rod (32) so that the lower clamp may be either fixed to the polished rod (32) or released from the polished rod (32). When the lower clamp (70) is fixed to the polished rod (32), the lower clamp (70) operably connects the motor (68) to the rod string (22) so that operation of the motor (68) rotates the lower clamp (70) which correspondingly rotates the rod string (22). The lower clamp (70) is commonly a standard 1¼ inches 6 bolt clamp having a rectangular cavity in its base to engage the motor (68). When attached to the polished rod (32), the lower clamp (70) is 3½ inches by 3½ inches square. When a 1½ inches diameter polished rod (32) is used, the lower clamp (70) is preferably a 1½ inches 6 bolt clamp being 4⅞ inches by 4⅞ inches square.

Referring to FIGS. 3 through 8, the device (20) is comprised of a tubular first sleeve, a tubular second sleeve, and an upper clamp (76). In the preferred embodiment, the first sleeve is mounted on the lower clamp (70) and the upper clamp (76) is mounted on the second sleeve. Further, in the preferred embodiment, the first sleeve is an inner sleeve (72) and the second sleeve is an outer sleeve (74) mounted about the inner sleeve (72). As a result, upon rotation of the lower clamp (70) by the motor (68), the outer sleeve (74) telescopes relative to the inner sleeve (72) in the manner described below. However, the device (20) could be designed so that the first sleeve is the outer sleeve, which is mounted on the lower clamp (70). The second sleeve would then be the inner sleeve and the upper clamp (76) would be mounted on it. As a result, upon rotation of the lower clamp (70) by the motor (68), the inner sleeve would telescope relative to the outer sleeve.

As indicated, in the preferred embodiment, in normal operation of the production well, the lower clamp (70) is fixed to the polished rod (32). Operation of the motor (68) rotates the lower clamp (70) to the right or clockwise, which also rotates the rod string (22) in a clockwise direction. When the device (20) is mounted on the wellhead (26), the inner sleeve (72) is mounted on the lower clamp (70), so that rotation of the lower clamp (70) by the motor (68) also causes the inner sleeve (72) to rotate to the right or in a clockwise direction. Rotation of the inner sleeve (72) will occur upon the operation of the motor (68) regardless of whether the lower clamp (70) is fixed to the polished rod (32), as in normal operation of the production well, or released from the polished rod (32) for operation of the device (20) as further described below.

Figure 7:
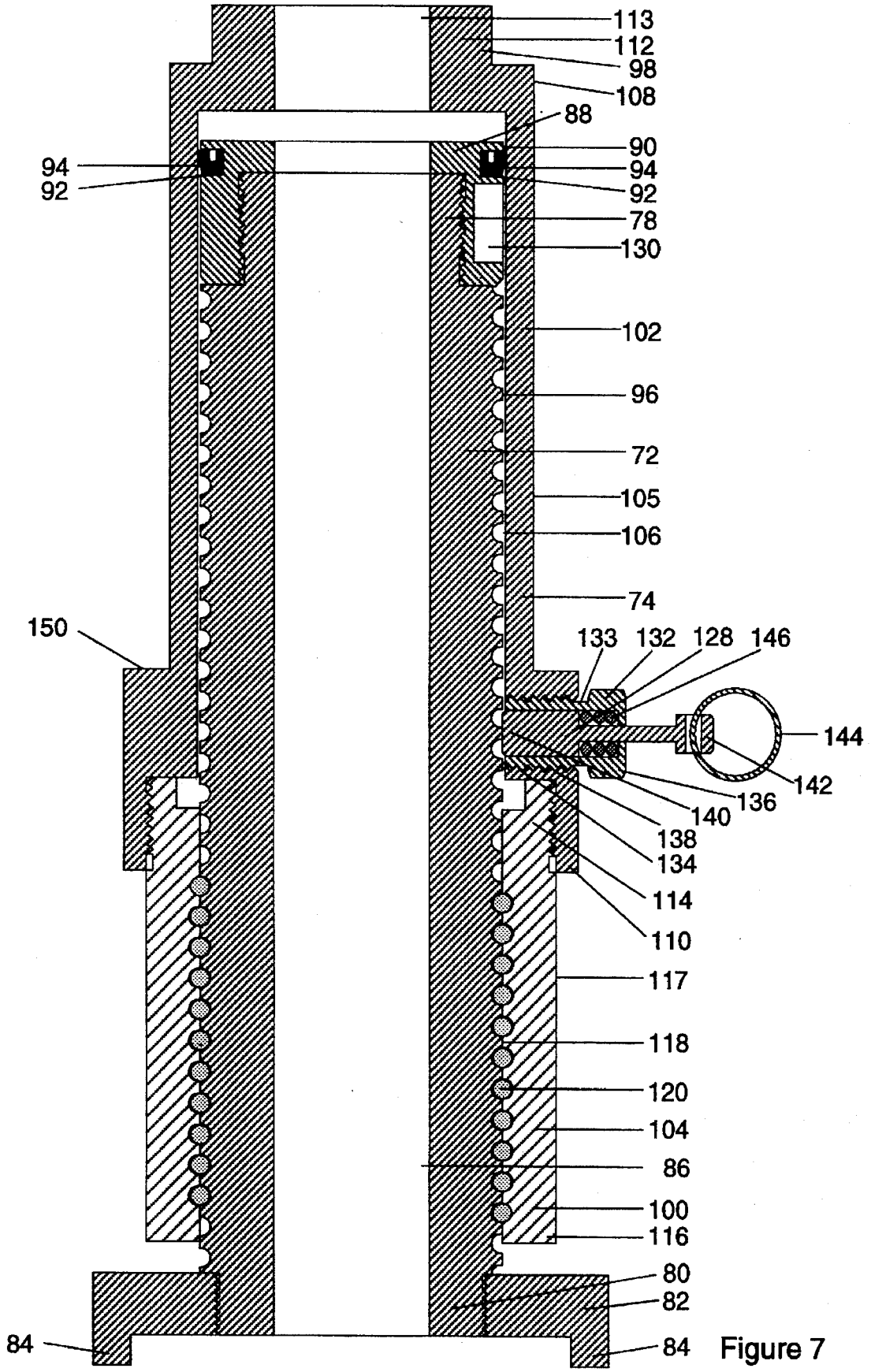
FIG. 7 is a longitudinal sectional view along line 7—7 of FIG. 6 showing the inner sleeve and the outer sleeve of the device in the closed position.
Figure 8:
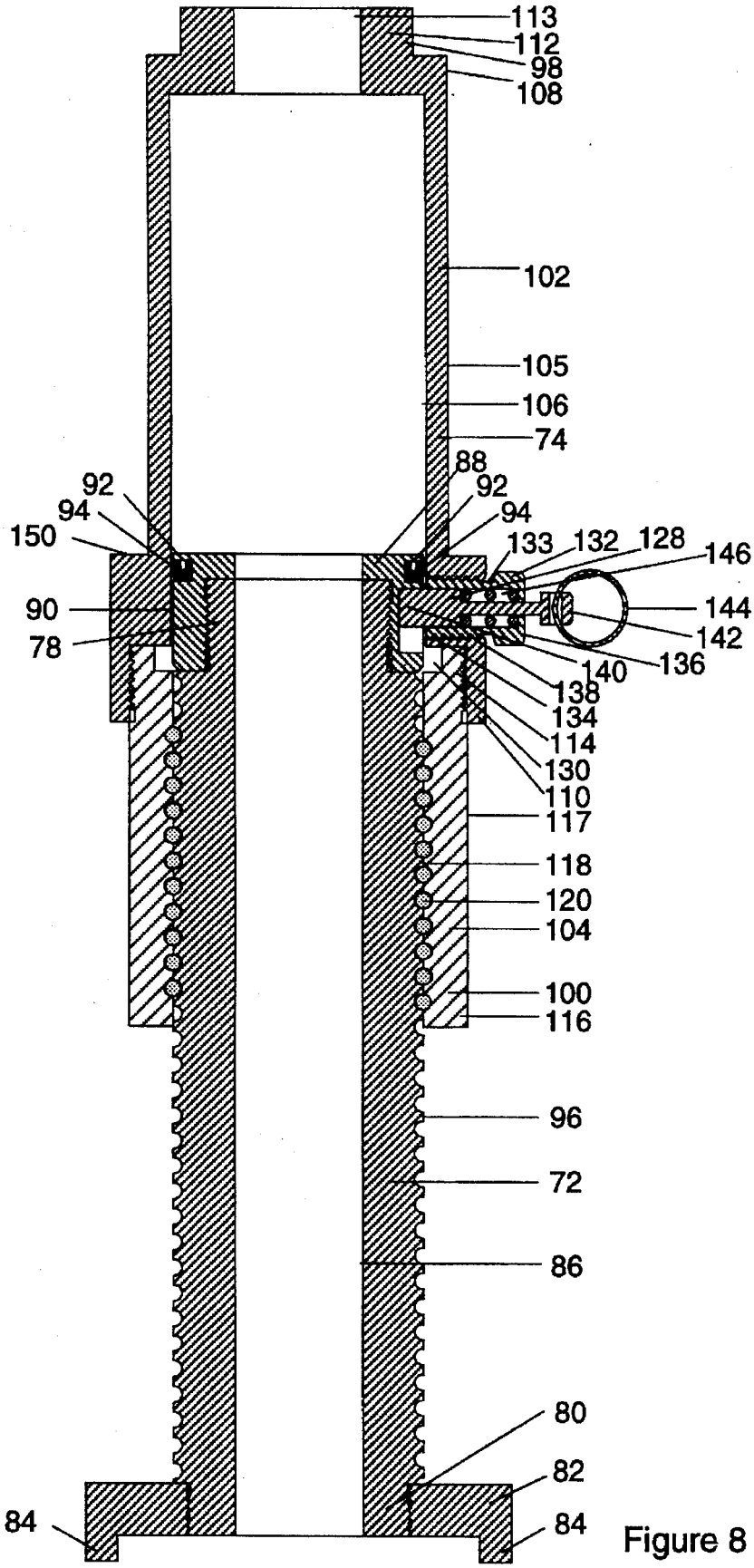
FIG. 8 is a longitudinal sectional view along line 7—7 of FIG. 6 showing the inner sleeve and the outer sleeve of the device in the extended position.

In the preferred embodiment, as shown more particularly in FIGS. 7 and 8, the inner sleeve (72) has an upper end (78) and a lower end (80). The lower end (80) is removably mounted on the lower clamp (70). For this purpose, the lower end (80) of the inner sleeve (72) is threadably engaged to a removable tubular base plate (82). Preferably the threads between the lower end (80) of the inner sleeve (72) and the base plate (82) are left hand threads so that rotation of the inner sleeve (72) relative to the base plate (82) to the left or counter-clockwise tightens the engagement between the threaded surfaces. During normal operation of the motor (68), the lower clamp (70) and inner sleeve (72) will be rotated in a clockwise direction. However, if friction acts on the inner sleeve (72) to inhibit its rotation, the inner sleeve (72) will be urged to rotate to the left relative to the base plate (82) and the engagement between the inner sleeve (72) and the base plate (82) will be tightened.

The base plate (82) includes two opposing shoulders (84) which extend towards the lower clamp (70) for engagement with it. The base plate (82) is removable and replaceable with differing sizes and shapes of base plate in order that a base plate may be attached which is compatible with the size and shape of the lower clamp (70) on the existing wellhead (26). By matching the base plate (82) with the existing lower clamp (70), the device (20) may be used on varying lower clamps (70) on different wellheads. Preferably, the base plate (82) is made from Grade 4140 steel, quenched and tempered to ASTM A193B7. Further, by way of example, if a standard 1¼ inch lower clamp (70) is present on the wellhead (26), a base plate (82) is used which has two shoulders (84) that are 3⅝ inches apart and extend downwards ¼ inch to engage the lower clamp (70). If a 1½ inches lower clamp (70) is present on the wellhead (26), the base plate (82) used is larger and the shoulders (84) are spaced about 5 inches apart.

When the inner sleeve (72) is mounted on the lower clamp (70) by the base plate (82), a portion of the polished rod (32) is contained within the bore (86) of the inner sleeve (72). Therefore, the bore (86) of the inner sleeve (72) is sized to allow the polished rod (32) to fit and longitudinally or rotationally move therein. The most commonly used polished rod (32) is 1¼ inches in diameter. In this case, the bore (86) of the inner sleeve (72) is preferably 1 9/32 inches so it will fit easily over the polished rod (32). If a 1½ inches diameter polished rod (32) is present, the bore (86) is preferably 1 17/32 inches.

A removable, tubular stopper ring (88) is preferably threadably engaged to the upper end (78) of the inner sleeve (72). Preferably, the threads between the upper end (78) and the stopper ring (88) are left hand threads so that rotation of the inner sleeve (72) relative to the stopper ring (88) to the left or counter-clockwise tightens the engagement between the threaded surfaces. Thus, if friction acts on the stopper ring (88) to inhibit its rotation during rotation of the inner sleeve (72) in a clockwise direction, the stopper ring (88) will be urged to rotate to the left and the stopper ring (88) will be tightened to the inner sleeve (72).

The stopper ring (88) is preferably made of Grade 4140 steel, quenched and tempered to ASTM A193B7. As well, the stopper ring (88) includes an outer surface (90) which defines a groove (92) about its circumference for receiving a seal ring (94). The seal ring (94) provides a seal between the outer surface (90) of the stopper ring (88) and the adjacent, abutting surface of the outer sleeve (74), as described further below, to inhibit the entry of silt, sand and other materials between the inner sleeve (72) and the outer sleeve (74). Preferably, the seal ring (94) is a 2½ inches standard polypak seal made of a nitrile compound.

The inner sleeve (72) is also comprised of a threaded outer surface (96). When the stopper ring (88) is engaged with the upper end (78) of the inner sleeve (72), the outer surface (90) of the stopper ring (88) is flush with the outer surface (96) of the remainder of the inner sleeve (72). Preferably, the threads on the outer surface (96) are right hand threads, for the reason discussed below, and extend along the entire outer surface (96) from the stopper ring (88) to the base plate (82).

In the preferred embodiment, the threaded outer surface (96) of the inner sleeve (72) is comprised of a ball screw which has a right hand thread. The ball screw is preferably 2.5 inches in diameter, has a thread pitch of ¼ inch, and is made of Grade 4150 steel. An example of such a ball screw is the Thomson Saginaw Part No. 30335231.

The outer sleeve (74), as shown in FIGS. 7 and 8, has an upper end (98) and a lower end (100). The outer sleeve (74)

is mounted about the inner sleeve (72) in order to permit telescoping of the outer sleeve (74) relative to the inner sleeve (72). In the preferred embodiment, the outer sleeve (74) is comprised of a tubular housing (102) and a tubular ball nut (104). The housing (102) comprises the upper end (98) of the outer sleeve (74) and includes an outer surface (105) and a smooth bore (106) such that no contact occurs between the bore (106) and the outer surface (96) of the inner sleeve (72) except where the seal ring (94) abuts against the bore (106) to seal the space between the stopper ring (88) and the housing (102). The housing (102) has an upper end (108) and a lower end (110). The upper end (108) includes a bore (113) sized to fit over the polished rod (32) and a rectangular protrusion (112) about its circumference for engaging the upper clamp (76) which is mounted thereon. In the preferred embodiment, the housing (102) is made of Grade 4140 steel, quenched and tempered to ASTM A193B7.

Figure 3:
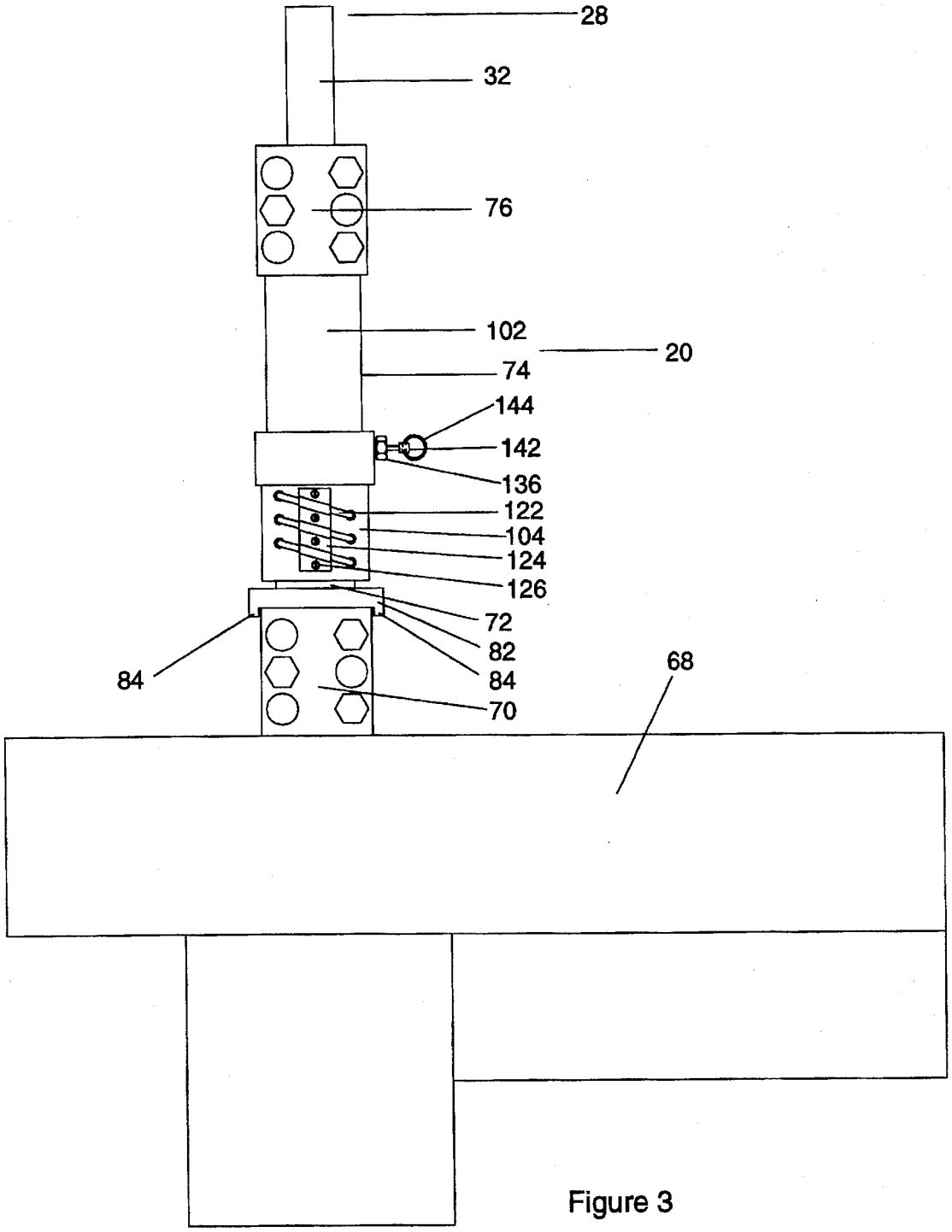
FIG. 3 is a pictorial side view of the device in a closed position, in which the device is mounted to the wellhead for operation.
Figure 4:
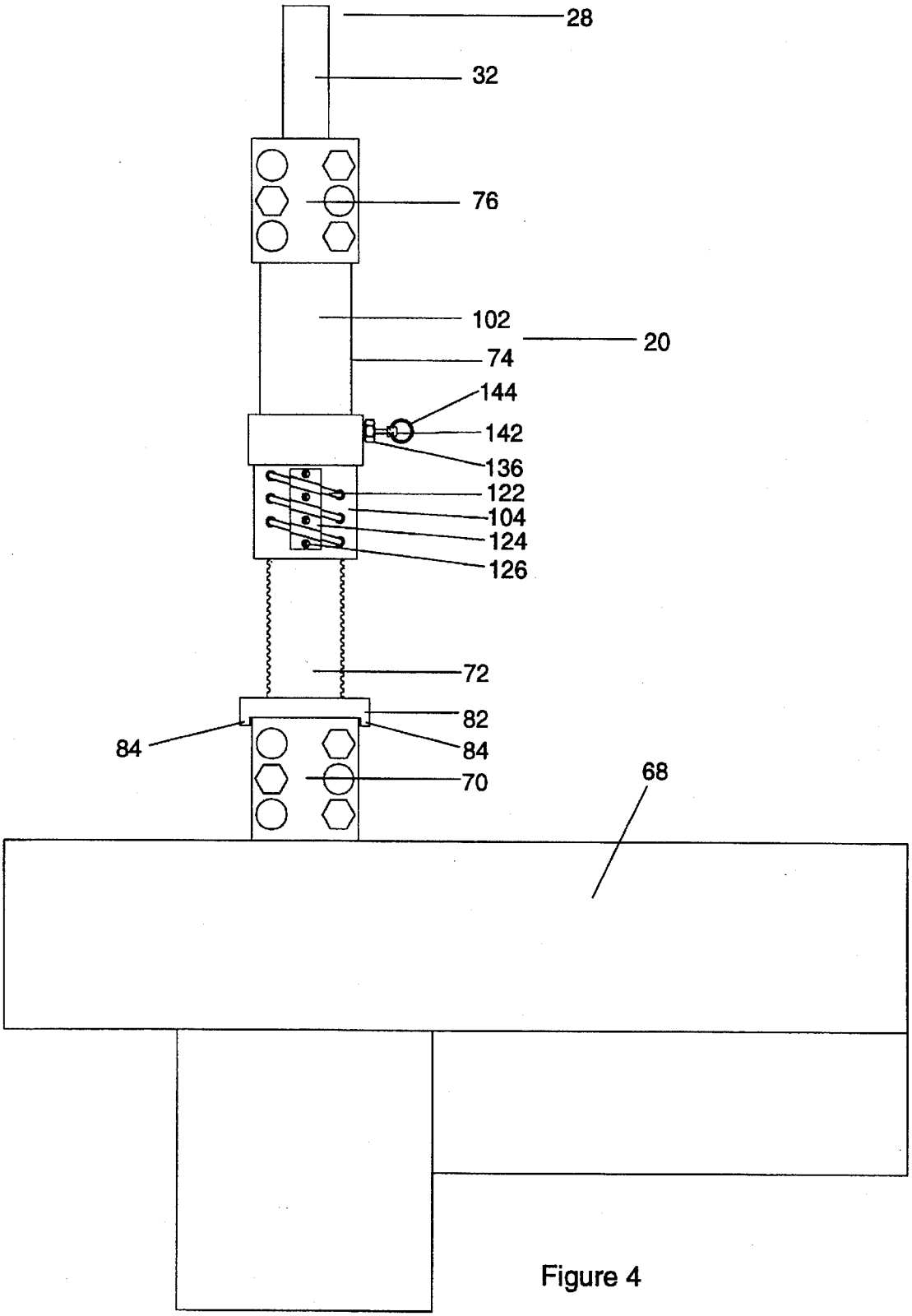
FIG. 4 is a pictorial side view of the device in an extended position, in which the device is mounted to the wellhead for operation.
Figure 6:
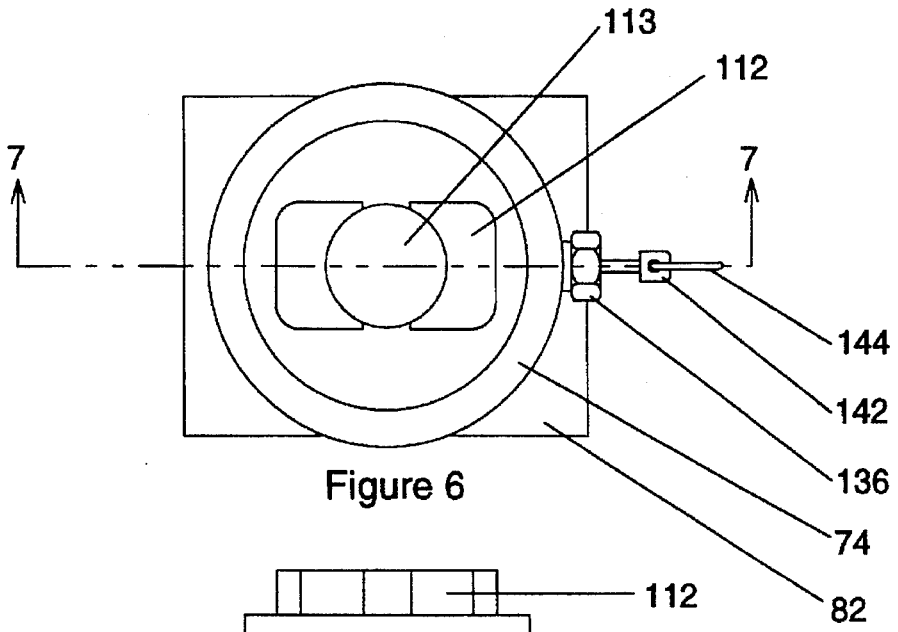
FIG. 6 is a pictorial top view of the inner sleeve and the outer sleeve of the device shown in FIG. 5.
Figure 5:
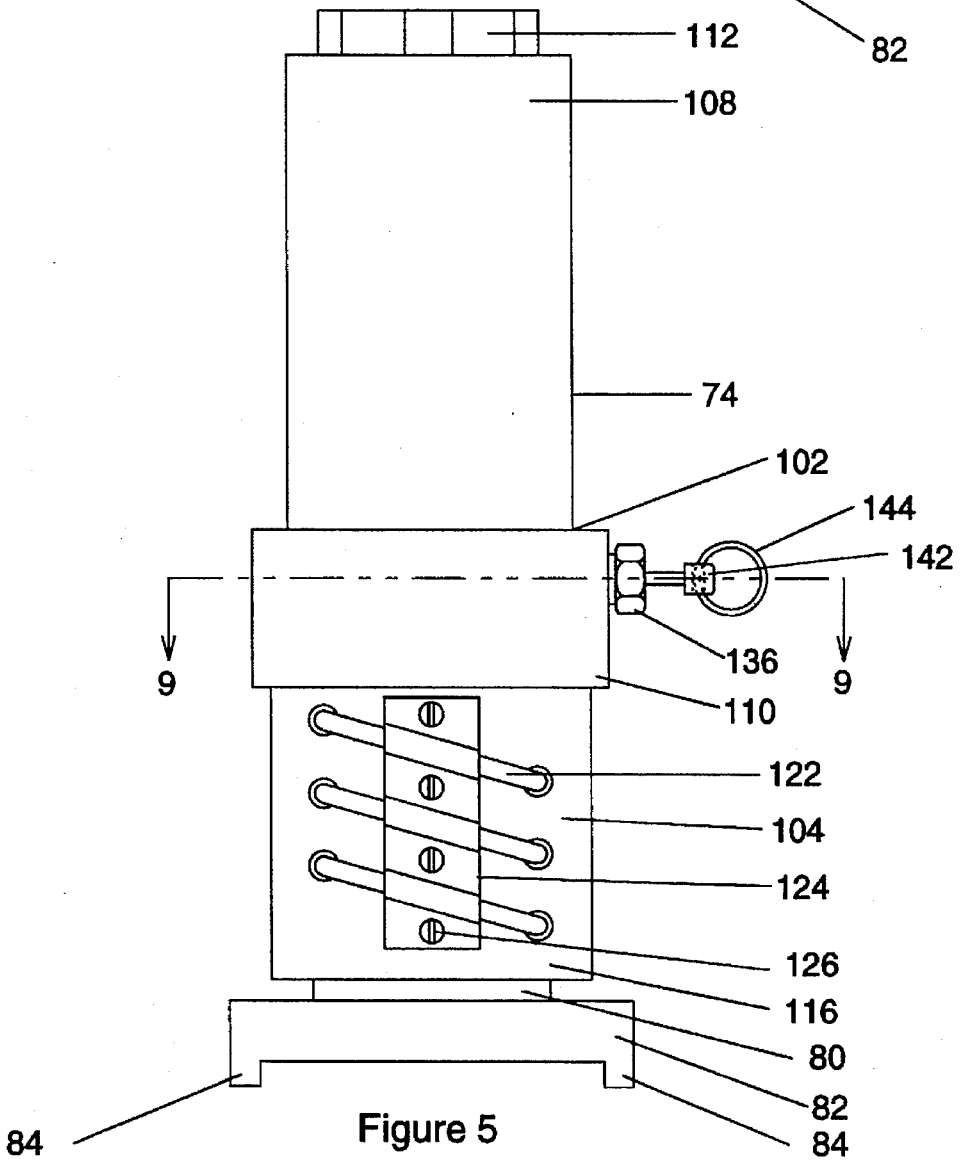
FIG. 5 is a pictorial side view of an inner sleeve and an outer sleeve of the device in the closed position.

The ball nut (104) comprises the lower end (100) of the outer sleeve (74) and also has an upper end (114) and a lower end (116). The upper end (114) of the ball nut (104) is threadably connected to the lower end (110) of the housing (102). Further, the ball nut (104) has an outer surface (117) and has a threaded inner surface (118) compatible with the threaded outer surface or ball screw (96) of the inner sleeve (72). The threaded inner surface (118) extends substantially from the upper end (114) to the lower end (116) of the ball nut (104). When the outer sleeve (74) is mounted about the inner sleeve (72), the inner surface (118) of the ball nut (104) is threadably engaged with the threaded outer surface (96) of the inner sleeve (72), being the ball screw, to permit telescoping of the outer sleeve (74) relative to the inner sleeve (72). A plurality of ball bearings (120) are contained in the threads between the ball nut (104) and the ball screw (96). As shown in FIGS. 3, 4 and 5, the ball nut (104) recycles the ball bearings (120), as the outer sleeve (74) telescopes, by a series of ball bearing recycle lines (122) running from the inner surface (118) of the ball nut (104) along the outer surface (117) and back to the inner surface (118). The recycle lines (122) are fixed in position on the outer surface (117) of the ball nut (104) by a retainer plate (124) connected to the outer surface (117) by a plurality of screws (126). In the preferred embodiment, the ball nut (104) has right hand threads and is preferably 2.5 inches in diameter with a thread pitch of ¼ inch. It is also preferably made of Grade 8620 steel. An example of such a ball nut (104) is the Thomson Saginaw Part No. 5703243.

The outer sleeve (74) telescopes between a closed position and an extended position. In the closed position, as shown in FIGS. 3, 5 and 7, the lower end (80) of the inner sleeve (72) is adjacent the lower end (100) of the outer sleeve (74) and the base plate (82) mounted thereon. In the extended position, as shown in FIGS. 4 and 8, the upper end (78) of the inner sleeve (72) is adjacent the lower end (110) of the housing (102). In the preferred embodiment, the outer sleeve (74) is capable of telescoping relative to the inner sleeve (72) for a distance of less than about one-half of the length of the polished rod (32), and preferably between about 4 and 5 inches.

The threads between the ball screw (96) and the ball nut (104) are preferably right hand threads. In other words, rotation of the ball nut (104) relative to the ball screw (96) to the right or clockwise causes the ball nut (104) to telescope towards the closed position. During operation of the device (20), the ball screw (96) rotates relative to the ball nut (104) to the right, and thus the ball nut (104) rotates relative to the ball screw (96) to the left. As a result, the ball nut (104) telescopes towards the extended position.

For the device (20) to operate properly, the outer sleeve (74) must not rotate substantially when the inner sleeve (72) is rotated by the motor (68). This means that the friction between the inner surface (118) of the ball nut (104) and the outer surface (96) of the inner sleeve (72) must be less than the total of the friction between the rotor (48) and the stator (50) plus the friction between the rod string (22) and the tubing string (25) and the wellhead (26). For this reason, the ball screw (96) and the ball nut (104) described above are preferably used in the device (20) in order to minimize the friction between the inner surface (118) of the ball nut (104) and the outer surface (96) of the inner sleeve (72). Ball screws (96) and nuts (104) typically have a low frictional drag compared to other types of threads. Therefore the friction is reduced sufficiently to allow the inner sleeve (72) to rotate within the outer sleeve (74) in order to permit telescoping of the outer sleeve (74) relative to the inner sleeve (72). Other types of threads may be used if they are highly polished and well lubricated in order to sufficiently reduce the friction.

Where the ball screw (96) and the ball nut (104) are not used and conventional threads on the inner sleeve (72) and the outer sleeve (74) are used, the device (20) may be further comprised of means for retarding or braking the rotation of the outer sleeve (74) while the inner sleeve (72) is rotated in order to inhibit rotation of the outer sleeve (74) resulting from friction between the inner sleeve (72) and the outer sleeve (74). Thus, telescoping of the outer sleeve (74) will be permitted upon the rotation of the inner sleeve (72).

Figure 11:
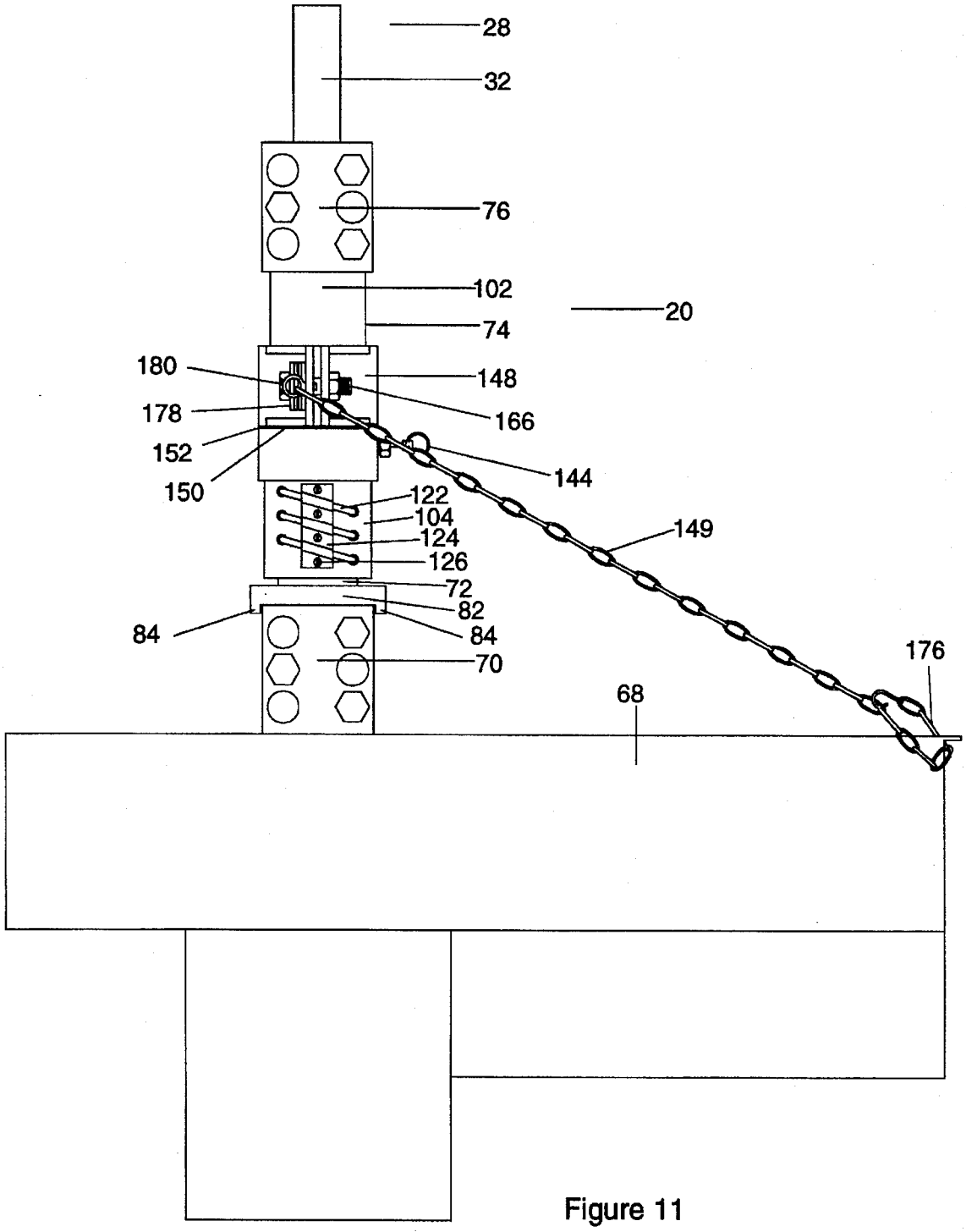
FIG. 11 is a pictorial side view of the device in a closed position, in which the device is mounted to the wellhead, the device including means for retarding the rotation of the outer sleeve.
Figure 13:
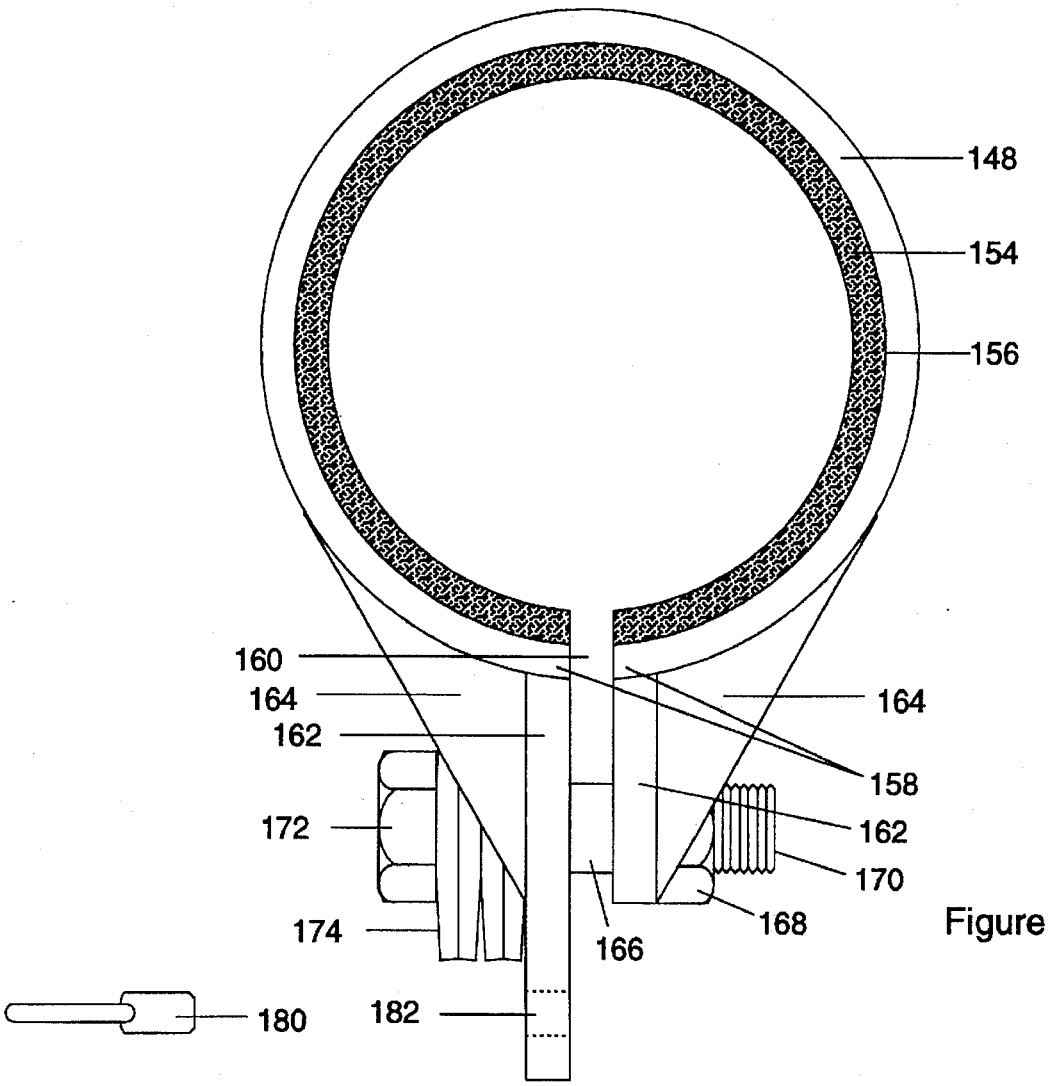
FIG. 13 is a pictorial top view of the retarding means shown in FIG. 12.
Figure 12:
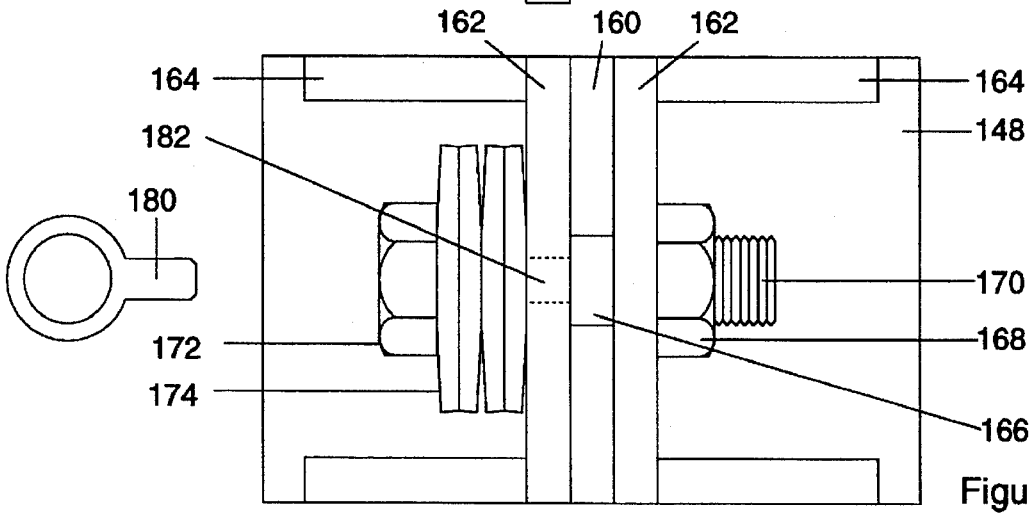
FIG. 12 is a pictorial side view of the retarding means shown in FIG. 11.

Referring to FIGS. 11 through 13, the retarding means are comprised of a C-shaped, tubular brake shoe (148)which is mounted about the housing (102) at its lower end (110), and a restraining chain (149) connected between the brake shoe (148) and the motor (68). Although FIG. 11 shows the retarding means in use with the ball screw (96) and the ball nut (104), the retarding means are preferably intended for use when the inner sleeve (72) and the outer sleeve (74) have conventional threads between them. Referring to FIGS. 7, 8 and 11, the housing (102) preferably includes a shoulder (150) at its lower end (110) upon which the brake shoe (148) is seated. As shown in FIG. 11, a bronze washer (152) may be located between the shoulder (150) and the brake shoe (148). In addition, a brake lining (154) is preferably bonded to an inner surface (156) of the brake shoe (148) in order that the inner surface (156) of the brake shoe (148) may more firmly grip the outer surface (105) of the housing (102).

Referring to FIGS. 12 and 13, the C-shaped brake shoe (148) includes two ends (158) which define an opening (160) therebetween. Once the brake shoe (148) is mounted about the housing (102), the ends (158) are moved into closer proximity with each other so that the brake lining (154) on the brake shoe (148) grips the housing (102). The ends (158) are moved closer together by a fastening system.

The fastening system is preferably comprised of a steel plate (162) which extends outwardly away from the brake shoe (148) from each of the ends (158) of the brake shoe (148), and means for fastening the steel plates (162) together. The steel plates (162) may be reinforced by gussets (164). In addition, each steel plate (162) preferably defines an opening therein for passage of the fastening means therethrough. In the preferred embodiment, the fastening means are comprised of a bolt (166) and a nut (168). A threaded first end (170) of the bolt (166) is passed through each of the openings in the steel plates (162) as shown in FIGS. 12 and 13. An enlarged second end (172) of the bolt (166) prevents its passage through the openings as well. A number of belville spring washers (174) may be located between the second end (172) and the adjacent steel plate (162) when the bolt (166) is in position in the openings in the steel plates (162).

Once the bolt (166) is in position in the openings in the steel plates (162), the nut (168) is screwed onto the threaded first end (170) of the bolt (166). Tightening of the nut (168) on the bolt (166) brings the ends (158) of the brake shoe (148) in closer proximity and decreases the size of the opening (160) between the ends (158). As a result, the brake shoe (148) more firmly grips the housing (102).

The restraining chain (149) has a first end (176) and a second end (178). The first end (176) is releasably connected to the motor (68). The second end (178) is releasably connected to the brake shoe (148). In the preferred embodiment, the second end (178) of the restraining chain (149) includes a clevis pin (180) and at least one of the steel plates (162) defines a hole (182) for receiving the clevis pin (180) therein. The clevis pin (180) is placed into the hole (182) in a manner so that upon the clockwise rotation of the outer sleeve (74), the restraining chain (149) is pulled tight and the clevis pin (180) is urged into the hole (182). Once the restraining chain (149) is pulled tight between the motor (68) and the brake shoe (148), further rotation of the outer sleeve (74) in a clockwise direction is retarded or inhibited. When the motor (68) is turned off, the outer sleeve (74) may typically experience some back spin. If this occurs, as the outer sleeve (74) and the brake shoe (148) rotate in a counter-clockwise direction, the clevis pin (180) is pulled from the hole (182) by the restraining chain (149) and thus the retarding means allow for the back spin which may be experienced when using the device (20).

In addition, in order that the outer sleeve (74) may telescope in the manner described herein, the first end (176) of the restraining chain (149) is preferably connected to the motor (68) as far away from the rod string (22) as possible. By decreasing the angle formed between the restraining chain (149) and the motor (68), telescoping of the outer sleeve (74) is not substantially hindered.

Referring to the preferred embodiment as shown in FIGS. 1, and 3 through 8, the upper clamp (76) preferably includes a rectangular cavity in its base for mounting on the rectangular protrusion (112) at the upper end (108) of the housing (102). However, alternate configurations of the outer sleeve (74) and the upper clamp (76) may be used, so long as the outer sleeve (74) is capable of engaging the upper clamp (76). The upper clamp (76) is releasably fixable to the polished rod (32). Thus, the upper clamp (76) may be fixed to the polished rod (32), in order to support the rod string (22) in the wellhead (26) and the wellbore (24), or released from the polished rod (32). Preferably, the upper clamp (76) is identical to the lower clamp (70), however, it may be of a different size and shape as long as the upper clamp (76) is capable of being mounted at the upper end (108) of the housing (102).

As indicated, upon rotation of the ball screw (96), the ball nut (104) and therefore the outer sleeve (74) telescopes on the ball screw (96) resulting in the longitudinal movement of the upper clamp (76) and the rod string (22) fixed thereto. The telescoping may be used for longitudinally adjusting the position of the rod string (22) in either direction. In other words, the device (20) may be designed either to lift or to lower the rod string (22) in the production well. However, in the preferred embodiment, the device (20) is designed, and the elements are connected, in the manner described herein so that normal operation of the motor (68) results in lifting of the rod string (22). Thus, the outer sleeve (74) is preferably telescoped relative to the inner sleeve (72) from the closed position towards the extended position.

Further, in the preferred embodiment, the device (20) includes means for fixing the outer sleeve (74) to the inner sleeve (72) when the rod string (22) has been lifted a desired distance. Preferably, the fixing means are operative when the outer sleeve (74) has telescoped to the extended position. The fixing means prevent further telescoping of the outer sleeve (74) relative to the inner sleeve (72). In particular, the fixing means will prevent further telescoping in the direction of the extended position so that the ball nut (104) remains mounted about the ball screw (96). As well, the fixing means will prevent the telescoping of the outer sleeve (74) relative to the inner sleeve (72) back towards the closed position when the motor (68) is inoperative, as described further below.

Figure 9:
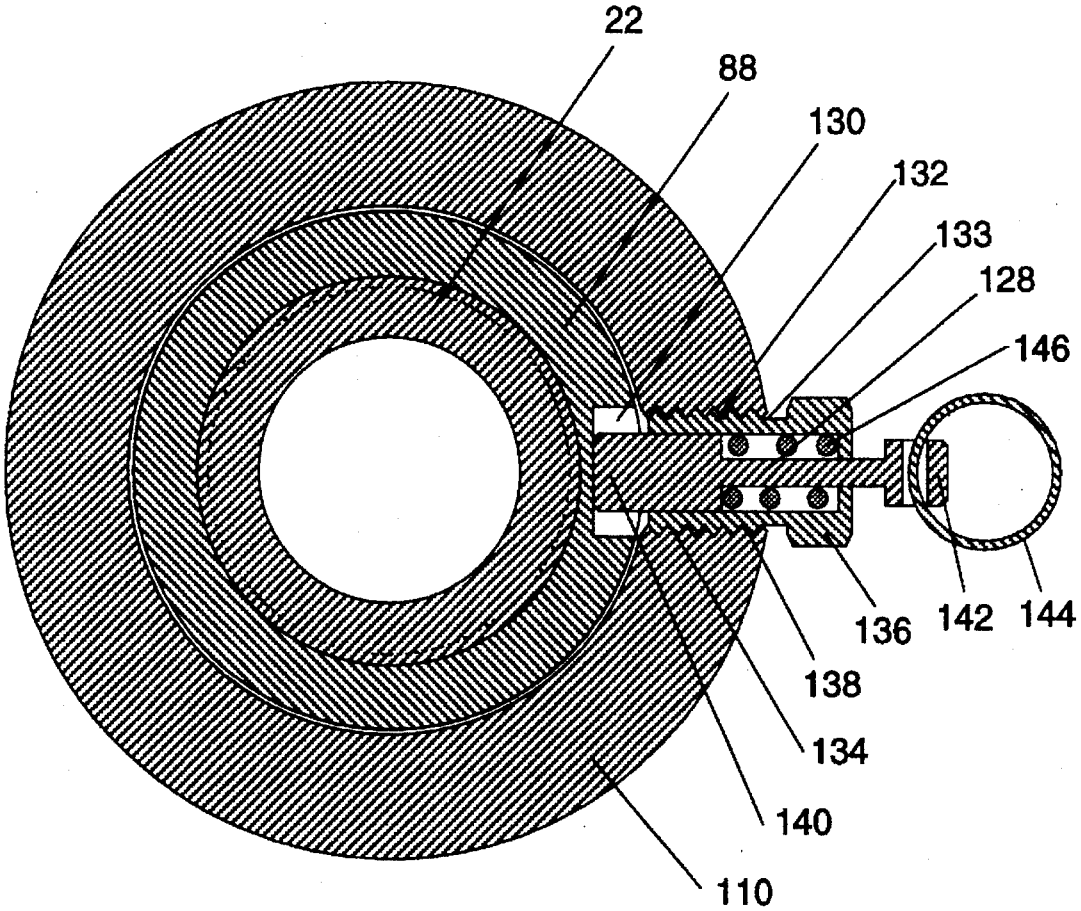
FIG. 9 is a cross-sectional view along line 9—9 of FIG. 5 showing, in detail, preferred means for fixing the outer sleeve to the inner sleeve.

Referring to FIGS. 7 through 9, the fixing means are comprised of a plunger (128) and a slot (130) for receiving the plunger (128). The plunger (128) is partially contained within a plunger housing (132) having a threaded outer surface (133). The plunger housing (132) has a first end (134) which extends through the housing (102), and an enlarged second end (136) located outside the housing (102). Preferably, the first end (134) of the plunger housing (132) extends through the housing (102) at the lower end (110) of the housing (102) adjacent the upper end (114) of the ball nut (104). The lower end (110) of the housing (102) defines an opening (138) from the outer surface (105) to the bore (106) of the housing (102). The bore of the opening (138) is threaded for engagement with the threaded outer surface (133) of the plunger housing (132). The plunger (128) is comprised of a first end (140), contained within the plunger housing (132) for releasably engaging the outer surface (96) of the inner sleeve (72), and a second end (142). The second end (142) extends from the first end (140) through the plunger housing (132) and outside of the housing (102). The second end (142) includes a pull ring (144) for manually pulling the first end (140) of the plunger (128) away from the outer surface (96) of the inner sleeve (72).

In addition, the plunger housing (132) includes means for urging the first end (140) of the plunger (128) towards the inner sleeve (72). In the preferred embodiment, the urging means is a spring (146) contained between the enlarged first end (140) of the plunger (128) and the second end (136) of the plunger housing (132). An example of a suitable plunger (128) and plunger housing (132) is the Reid Tool Supply Part No. PRSN-625 for a plunger assembly made of hardened steel.

The slot (130) is defined by the outer surface (90) of the stopper ring (88). The slot (130) is sized to receive the first end (140) of the plunger (128) therein. Thus, when the first end (140) is adjacent the slot (130), the spring (146) urges the first end (140) into the slot (130). When the first end (140) is received in the slot (130), the outer sleeve (74) is fixed to the inner sleeve (72). Thus, when the motor (68) is operative, the inner sleeve (72) and the outer sleeve (74) rotate together as a unit. When the motor (68) is inoperative, telescoping of the outer sleeve (74) relative to the inner sleeve (72) back towards the closed position is prevented. This is particularly important when using a ball screw (96) and a ball nut (104). The outer sleeve (74) may be urged to telescope back towards the closed position due to back up torque resulting from the weight of the rod string (22) and the relatively low friction between the ball screw (96) and the ball nut (104).

Further, the plunger (128) and the slot (130) are positioned so that upon the telescoping of the outer sleeve (74)

relative to the inner sleeve (72), the plunger (128) is received in the slot (130) before the ball nut (104) reaches the stopper ring (88) in order to prevent the ball bearings (120) from binding and wedging against the stopper ring (88). Once the rod string (22) has been lifted as described above, the device (20) can be reset for lifting the rod string (22) further by tightening the lower clamp (70), loosening the upper clamp (76), pulling on the pull ring (144) to disengage the first end (140) of the plunger (128) from the slot (130), and manually rotating the outer sleeve (74) until the outer sleeve (74) returns to the closed position.

Figure 10:
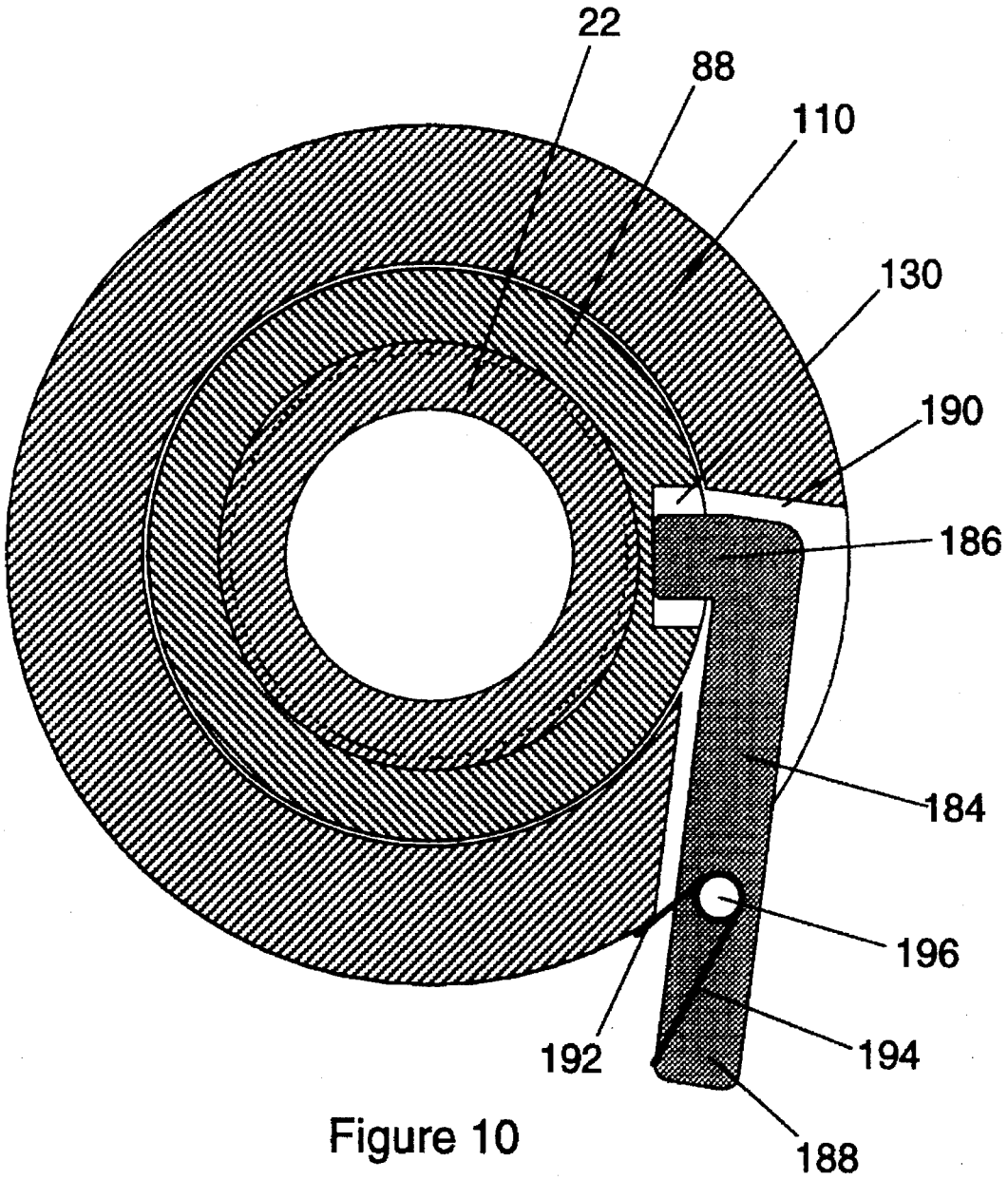
FIG. 10 is a cross-sectional view along the same line as FIG. 9 showing, in detail, an alternate means for fixing the outer sleeve to the inner sleeve.

As an alternative to the plunger (128) and the slot (130), the fixing means may be comprised of a pawl assembly, as shown in FIG. 10, between the inner sleeve (72) and the outer sleeve (74). However, the plunger (128) is preferred as it is easier to assemble and seals better to prevent sand or dirt getting into the ball screw (96) threads.

The pawl assembly is more particularly shown in FIG. 10. The pawl assembly is comprised of a pawl (184) having a first end (186) and a second end (188). The first end (186) of the pawl (184) is formed at an angle to the longitudinal axis of the pawl (184) and is sized to be received within the slot (130), as described above, when the first end (186) is adjacent the slot (130). The first end (186) of the pawl (184) extends through the lower end (110) of the housing (102) at the same location as described for the plunger (128). The housing (102) defines a window (190) for passage of the pawl (184) therethrough. Further, the first end (186) of the pawl (184) is urged into the slot (130) by a top and bottom torsion spring (192, 194) wound about an axle (196) at the second end (188) of the pawl (184) as shown in FIG. 10.

As indicated previously, during normal operation of the production well, the lower clamp (70) is fixed to the polished rod (32) in order to support the rod string (22) in the wellhead (26) and the wellbore (24). To use the device (20) for longitudinally adjusting the position of the rod string (22), the motor (68) is turned off and the device (20) is mounted on the wellhead (26) in its closed position by mounting the base plate (82) on the lower clamp (70) such that a portion of the polished rod (32) is contained within the bore (86) of the inner sleeve (72) and the bore (113) of the upper end (108) of the housing (102). Further, it is mounted so that rotation of the lower clamp (70) by the motor (68) rotates the inner sleeve (72).

The upper clamp (76) is then fixed to the polished rod (32), following which the lower clamp (70) is released from the polished rod (32). As a result, the rod string (22) is supported in the wellhead (26) and the wellbore (24) by the upper clamp (76) only. The motor (68) is then turned on. Normal operation of the motor (68) rotates the lower clamp (70) and the inner sleeve (72) mounted thereon. The outer sleeve (74) and the upper clamp (76) mounted thereon do not rotate. As a result of the threaded connection between the inner sleeve (72) and the outer sleeve (74), the rotation of the inner sleeve (72) causes the outer sleeve (74) to telescope relative to the inner sleeve (72). In the preferred embodiment, the inner sleeve (72) and the outer sleeve (72) are jacked apart and the outer sleeve (74) telescopes relative to the inner sleeve (72) from the closed position towards the extended position resulting in the lifting of the rod string (22) by the upper clamp (76). However, as stated, the device (20) and the threaded connections between the elements of it may also be designed to lower the rod string (22) by telescoping from the extended position towards the closed position. Specifically, the device (20) fabricated to lower the rod string (22) must have a ball screw (96) and a ball nut (104) with left hand threads.

As stated above, in order that the inner sleeve (72) is rotatable within the outer sleeve (74) in order to permit the telescoping movement, the friction between the inner surface (118) of the outer sleeve (74) and the outer surface (96) of the inner sleeve (72) is preferably minimized during operation of the motor (68). In the preferred embodiment, the friction is minimized by using the ball screw (96) and the ball nut (104). In an alternate embodiment using conventional threads on the inner sleeve (72) and the outer sleeve (74), the forces of friction are greater and rotation of the outer sleeve (74) may need to be retarded or inhibited during operation of the motor (68).

When the outer sleeve (74) has telescoped relative to the inner sleeve (72) to the extended position, the outer sleeve (74) is fixed to the inner sleeve (72) by the receipt of the plunger (128) in the slot (130). Thus, further operation of the motor (68) will rotate both the inner sleeve (72) and the outer sleeve (74), resulting in rotation of the upper clamp (76) which will rotate the polished rod (32). However, once the plunger (128) is received in the slot (130), the motor (68) is preferably turned off. When the motor (68) is off, the plunger (128) prevents the telescoping of the outer sleeve (74) relative to the inner sleeve (72) back towards the closed position. The outer sleeve (74) may be urged to telescope towards the closed position if the outer sleeve (74) and the motor (68) are allowed to freewheel backwards due to backup torque resulting from the weight of the rod string (22) and the relatively low friction between the ball screw (96) and the ball nut (104). If a retarding means is used, as discussed above, the retarding torque should be set low enough such that the motor (68) can rotate the outer sleeve (74) and the inner sleeve (72) when the plunger (128) is received in the slot (130).

After the motor (68) is turned off, the lower clamp (70) is fixed to the polished rod (32). Then, the upper clamp (76) is released from the polished rod (32) so that the lower clamp (70) alone supports the rod string (22) in the production well. If desired, the plunger (128) may be pulled from the slot (130) by the pull ring (144) and the outer sleeve (74) may be manually rotated thus telescoping it relative to the inner sleeve (72) back towards the closed position. The above noted steps may then be repeated to progressively lift the rod string (22) a greater distance in the production well. The device (20) is then removed from the wellhead (26) for use on another production well. For this reason, the device (20) is designed to be portable and capable of being mounted on different types and sizes of wellhead (26).

The embodiments of the invention in which an exclusive property or privilege is claimed are defined as follows:

1. A device for longitudinally adjusting the position of a rotating rod string, having an upper end and a lower end, in a production well of the type having a downhole rotary pump connected to the lower end of the rod string, means for driving the rotary pump by rotating the rod string, and a lower clamp operably connected to the driving means and releasably fixable near the upper end of the rod string in order to connect the driving means to the rod string and in order to support the rod string in the well such that operation of the driving means rotates the lower clamp which rotates the rod string, the device comprising:

(a) a tubular first sleeve having a threaded surface, an upper end and a lower end for removably mounting on the lower clamp such that a portion of the rod string is contained within the first sleeve and rotation of the lower clamp by the driving means rotates the first sleeve;

(b) a tubular second sleeve having an upper end, a lower end and a threaded surface for engaging the threaded surface of the first sleeve, the second sleeve mounted and threadably engaged with the first sleeve to permit telescoping of the second sleeve relative to the first sleeve; and (c) an upper clamp mounted on the upper end of the second sleeve and releasably fixable to the rod string for supporting the rod string in the well so that while the lower clamp is released from the rod string and the upper clamp is fixed to the rod string, operation of the driving means rotates the lower clamp and the first sleeve such that the second sleeve telescopes relative to the first sleeve until the rod string is longitudinally adjusted within the well by longitudinal movement of the upper clamp resulting from the telescoping of the second sleeve relative to the first sleeve.

2. The device as claimed in claim 1 wherein the driving means rotates the lower clamp and the first sleeve such that the second sleeve telescopes relative to the first sleeve from a closed position towards an extended position.

3. The device as claimed in claim 1 further comprising means for retarding the rotation of the second sleeve while the first sleeve is rotated in order to permit telescoping of the second sleeve relative to the first sleeve.

4. The device as claimed in claim 1 wherein the first sleeve is comprised of an inner sleeve having a threaded outer surface and the second sleeve is comprised of an outer sleeve having a threaded inner surface, and wherein the outer sleeve is mounted about the inner sleeve such that the outer surface of the inner sleeve is threadably engaged with the inner surface of the outer sleeve.

5. The device as claimed in claim 4 wherein the driving means rotates the lower clamp and the inner sleeve such that the outer sleeve telescopes relative to the inner sleeve from a closed position towards an extended position.

6. The device as claimed in claim 4 further comprising means for retarding the rotation of the outer sleeve while the inner sleeve is rotated in order to permit telescoping of the outer sleeve relative to the inner sleeve.

7. The device as claimed in claim 4 wherein the threaded outer surface on the inner sleeve is comprised of a ball screw and the threaded inner surface on the outer sleeve is comprised of a ball nut such that the inner sleeve is rotatable within the outer sleeve in order to permit telescoping of the outer sleeve relative to the inner sleeve.

8. The device as claimed in claim 5 wherein the threaded outer surface on the inner sleeve is comprised of a ball screw and the threaded inner surface on the outer sleeve is comprised of a ball nut such that the inner sleeve is rotatable within the outer sleeve in order to permit telescoping of the outer sleeve relative to the inner sleeve.

9. The device as claimed in claim 8 further comprising means for fixing the outer sleeve to the inner sleeve in order to prevent further telescoping of the outer sleeve relative to the inner sleeve when the outer sleeve is in the extended position.

10. The device as claimed in claim 9 wherein the fixing means are comprised of a plunger having a first end extending through the outer sleeve for releasable engagement with the inner sleeve, and the outer surface of the inner sleeve defining a slot for receiving the plunger.

11. The device as claimed in claim 10 wherein the fixing means are further comprised of means for urging the first end of the plunger towards the inner sleeve such that the first end is urged into the slot when the slot is adjacent the first end of the plunger.

12. The device as claimed in claim 11 wherein the urging means are comprised of a spring.

13. The device as claimed in claim 10 wherein the first end of the plunger extends through the outer sleeve between the ball nut and the upper end of the outer sleeve, and wherein the outer surface of the inner sleeve at the upper end of the inner sleeve defines the slot.

14. The device as claimed in claim 13 wherein the fixing means are further comprised of means for urging the first end of the plunger towards the inner sleeve such that the first end is urged into the slot when the slot is adjacent the first end of the plunger.

15. The device as claimed in claim 14 wherein the urging means are comprised of a spring.

16. The device as claimed in claim 9 wherein the fixing means are comprised of a pawl assembly between the inner sleeve and the outer sleeve.

17. The device as claimed in claim 4 wherein the rod string is comprised of a polished rod having a length and the outer sleeve is capable of telescoping relative to the inner sleeve for a distance of less than about one-half of the length of the polished rod.

18. The device as claimed in claim 17 wherein the outer sleeve is capable of telescoping relative to the inner sleeve for a distance of between about 4 inches and 5 inches.

19. A method for longitudinally adjusting the position of a rotating rod string, the rod string having an upper end and a lower end, in a production well of the type having a downhole rotary pump connected to the lower end of the rod string, means for driving the rotary pump by rotating the rod string, and a lower clamp operably connected to the driving means and releasably fixed near the upper end of the rod string in order to connect the driving means to the rod string, and in order to support the rod string in the well such that operation of the driving means rotates the lower clamp which rotates the rod string, the method using a device comprised of a tubular first sleeve having a threaded surface, an upper end and a lower end for removably mounting on the lower clamp, a tubular second sleeve having an upper end, a lower end and a threaded surface for engaging the threaded surface of the first sleeve, the second sleeve mounted and threadably engaged with the first sleeve to permit telescoping of the second sleeve relative to the first sleeve, and an upper clamp mounted on the upper end of the second sleeve and releasably fixable to the rod string, the method comprising the steps of:

(a) mounting the device on the well by mounting the lower end of the first sleeve on the lower clamp such that a portion of the rod string is contained within the first sleeve and rotation of the lower clamp by the driving means rotates the first sleeve;

(b) fixing the upper clamp to the rod string;

(c) releasing the lower clamp from the rod string such that the upper clamp supports the rod string in the well; and (d) operating the driving means in order to rotate the lower clamp and the first sleeve such that the second sleeve telescopes on the first sleeve until the rod string is longitudinally adjusted within the well by longitudinal movement of the upper clamp resulting from the telescoping of the second sleeve relative to the first sleeve.

20. The method as claimed in claim 19 wherein the driving means rotates the lower clamp and the first sleeve such that the second sleeve telescopes relative to the first sleeve from a closed position towards an extended position.

21. The method as claimed in claim 20 further comprising the steps following step (d) of:

(e) fixing the lower clamp to the rod string once the rod string has been longitudinally adjusted;

(f) releasing the upper clamp from the rod string such that the lower clamp supports the rod string in the well; and (g) removing the device from the well.

22. The method as claimed in claim 21 further comprising the steps following step (f) of:

(h) telescoping the second sleeve relative to the first sleeve back towards the closed position; and (i) repeating steps (b) through (f) in order to progressively adjust the rod string in the well.

23. The method as claimed in claim 20 further comprising the step of retarding the rotation of the second sleeve during step (d) in order to permit telescoping of the second sleeve relative to the first sleeve.

24. The method as claimed in claim 19 wherein the first sleeve is comprised of an inner sleeve having a threaded outer surface and the second sleeve is comprised of an outer sleeve having a threaded inner surface and wherein the outer sleeve is mounted about the inner sleeve such that the outer surface of the inner sleeve is threadably engaged with the inner surface of the outer sleeve.

25. The method as claimed in claim 24 wherein the driving means rotates the lower clamp and the inner sleeve such that the outer sleeve telescopes relative to the inner sleeve from a closed position towards an extended position.

26. The method as claimed in claim 25 further comprising the steps following step (d) of:

(e) fixing the lower clamp to the rod string once the rod string has been longitudinally adjusted;

(f) releasing the upper clamp from the rod string such that the lower clamp supports the rod string in the well; and (g) removing the device from the well.

27. The method as claimed in claim 26 further comprising the steps following step (f) of:

(h) telescoping the outer sleeve relative to the inner sleeve back towards the closed position; and (i) repeating steps (b) through (f) in order to progressively adjust the rod string in the well.

28. The method as claimed in claim 25 further comprising the step of retarding the rotation of the outer sleeve during step (d) in order to permit telescoping of the outer sleeve relative to the inner sleeve.

29. The method as claimed in claim 25 further comprising the step of minimizing the friction between the inner surface of the outer sleeve and the outer surface of the inner sleeve during step (d) such that the inner sleeve is rotatable within the outer sleeve in order to permit telescoping of the outer sleeve relative to the inner sleeve.

30. The method as claimed in claim 29 further comprising the step of fixing the outer sleeve to the inner sleeve following step (d) in order to prevent further telescoping of the outer sleeve relative to the inner sleeve.

* * * * *